US005183311A

United States Patent [19]

Meeker et al.

[11] Patent Number: 5,183,311

[45] Date of Patent: Feb. 2, 1993

[54] PORTABLE HIGH CHAIR/BOOSTER SEAT

[75] Inventors: Paul K. Meeker, Aurora; William R. Gibson, Canton, both of Ohio

[73] Assignee: Lisco, Inc., Tampa, Fla.

[21] Appl. No.: 908,960

[22] Filed: Jul. 6, 1992

Related U.S. Application Data

[63] Continuation of Ser. No. 564,249, Aug. 8, 1990, abandoned.

[51] Int. Cl.[5] ..... A47B 83/02

[52] U.S. Cl. ..... 297/151; 297/153; 297/338; 297/250; 297/443; 297/444

[58] Field of Search ..... 297/250, 148, 149, 151, 297/153, 442, 443, 444, 338; 292/19, 20

[56] References Cited

U.S. PATENT DOCUMENTS

| | | | |
|---|---|---|---|
| D. 148,380 | 1/1948 | Noel | D15/8 |
| D. 152,383 | 1/1949 | Waaranan | D15/8 |
| D. 157,959 | 4/1950 | Kahan | D15/8 |
| D. 218,420 | 8/1970 | Weldner | D15/1 |
| D. 221,425 | 8/1971 | Pasakarmia, Jr. | D6/1 |
| D. 222,451 | 10/1971 | Lamb | D6/2 |
| D. 229,047 | 11/1973 | Lockwood | D6/2 |
| D. 230,784 | 3/1974 | Lo Turco | D6/1 |
| D. 246,682 | 12/1977 | Nakao | D6/7 |
| D. 251,641 | 4/1979 | Chacon | D6/63 |
| 257,065 | 4/1882 | Pursell . | |
| D. 268,630 | 4/1983 | Wilson | D6/9 |
| D. 276,098 | 10/1984 | Cone | D6/333 |
| D. 276,099 | 10/1984 | Cone | D6/333 |
| D. 280,578 | 9/1985 | Holden | D6/367 |
| D. 283,855 | 5/1986 | Kujawski | D6/333 |
| D. 286,471 | 11/1986 | Solloway | D6/333 |
| D. 289,830 | 5/1987 | Kain | D6/333 |
| D. 291,032 | 7/1987 | Sauter et al. | D6/333 |
| D. 300,992 | 5/1989 | Cleavenger | D6/333 |
| 1,336,641 | 4/1920 | Linke . | |
| 1,408,114 | 2/1922 | Mathieu . | |
| 1,465,291 | 8/1923 | Walker . | |
| 1,508,697 | 9/1924 | Junker . | |
| 2,279,864 | 4/1942 | Eide | 211/184 |
| 2,285,845 | 6/1942 | Stinson | 297/151 |
| 2,418,731 | 4/1947 | Seitz | 155/127 |
| 2,456,111 | 12/1948 | Creech | 155/124 |
| 2,466,350 | 4/1949 | Anderson | 155/123 |
| 2,478,280 | 8/1949 | Kroll et al. | 297/151 |
| 2,515,527 | 7/1950 | Robinson | 155/131 |
| 2,530,474 | 11/1950 | Lutes | 155/31 |
| 2,538,231 | 1/1951 | Booth | 128/58 |
| 2,550,811 | 5/1951 | Herbert | 155/41 |
| 2,554,851 | 5/1951 | Borthwick | 155/41 |

(List continued on next page.)

FOREIGN PATENT DOCUMENTS

| | | |
|---|---|---|
| 2813743A1 | 10/1979 | Fed. Rep. of Germany . |
| 3517841A1 | 11/1986 | Fed. Rep. of Germany . |
| 3710505A1 | 10/1987 | Fed. Rep. of Germany . |
| 61-19349 | 2/1986 | Japan . |
| 62-150955 | 10/1986 | Japan . |
| 932781 | 7/1963 | United Kingdom . |
| 2006617A | 7/1977 | United Kingdom . |

OTHER PUBLICATIONS

Juvenile Merchandising, Feb. 1987, vol. 41, No. 2 "The Graduate Booster Seat" by Pansy Ellen.

*Primary Examiner*—Kenneth J. Dorner

*Assistant Examiner*—Milton Nelson, Jr.

*Attorney, Agent, or Firm*—Donald R. Bahr; John E. Benoit

[57] ABSTRACT

A high chair and/or booster seat is disclosed which comprises two modular side panels, a modular back panel, a modular seat panel, and a tray which is easily assembled and disassembled by interlocking side panels without the use of screws or the like. To assemble, the back panel is interlocked between the two side panels and the seat is interlocked with the side panels and back panel. The seat is adjustable in height to three different positions. The tray is removably secured to the upper edges of the side panels and is adjustable to three different positions along the upper edges of said side panels. A harness system is provided for securing the seat to an adult chair and for securing the child within the chair. The seat may be used alone with or without the tray or may be secured to an adult chair and used with or without the tray.

6 Claims, 5 Drawing Sheets

OTHER PUBLICATIONS

| | | | |
|---|---|---|---|
| 2,620,857 | 12/1952 | Sarnak | 155/50 |
| 2,672,181 | 3/1954 | Rose | 155/43 |
| 2,682,915 | 7/1954 | Forti | 155/112 |
| 2,721,603 | 10/1955 | Faulconer | 155/11 |
| 2,776,700 | 1/1957 | Potter et al. | 297/442 X |
| 2,828,807 | 4/1958 | Skeoch | 155/153 |
| 2,988,844 | 6/1961 | Frimberger | 46/30 |
| 3,027,202 | 3/1962 | Gottfried et al. | 297/151 X |
| 3,078,101 | 2/1963 | Reese | 280/30 |
| 3,127,215 | 3/1964 | Hubbard | 297/118 |
| 3,335,434 | 8/1967 | Gamon | 297/250 |
| 3,460,866 | 8/1969 | Kessel | 297/258 |
| 3,516,709 | 6/1970 | Nader | 297/153 |
| 3,527,497 | 9/1970 | Self | 297/442 |
| 3,575,465 | 4/1971 | Dolby et al. | 297/118 |
| 3,724,895 | 4/1973 | Brand | 297/348 |
| 3,761,969 | 10/1973 | Meade | 5/108 |
| 3,788,700 | 1/1974 | Wartes | 297/442 |
| 3,874,726 | 4/1975 | Sebel et al. | 297/239 |
| 4,056,295 | 11/1977 | Downing | 312/107 |
| 4,108,489 | 8/1978 | Salzman | 297/37 |
| 4,109,961 | 8/1978 | Opsvik | 297/338 |
| 4,140,065 | 2/1979 | Chacon | 108/156 |
| 4,230,362 | 10/1980 | Euwema et al. | 297/174 |
| 4,235,474 | 11/1980 | Rosenberg | 297/465 |
| 4,266,306 | 5/1981 | Lee | 4/572 |
| 4,341,419 | 7/1982 | Sebel | 297/239 |
| 4,348,048 | 9/1982 | Thevenot | 297/250 |
| 4,453,764 | 6/1984 | Hennessy | 297/153 |
| 4,521,052 | 6/1985 | Cone | 297/3 |
| 4,553,786 | 11/1985 | Lockett, III et al. | 297/250 X |
| 4,563,040 | 1/1986 | Alster | 197/440 |
| 4,568,122 | 2/1986 | Kain | 297/488 |
| 4,586,747 | 5/1986 | Taylor | 297/250 |
| 4,593,950 | 6/1986 | Infanti | 297/3 |
| 4,603,903 | 8/1986 | Moscovitch | 297/250 |
| 4,643,474 | 2/1987 | Wise et al. | 254/250 |
| 4,650,246 | 3/1987 | Henriksson | 297/250 |
| 4,662,678 | 5/1987 | Halpert | 297/239 |
| 4,662,683 | 5/1987 | Knoedler et al. | 297/488 |
| 4,674,758 | 6/1987 | Valley et al. | 280/33.99 B |
| 4,687,255 | 8/1987 | Klanner et al. | 297/488 |
| 4,728,151 | 3/1988 | Neufelt | 297/438 |
| 4,743,063 | 5/1988 | Foster, Jr. | 297/130 |
| 4,754,999 | 7/1988 | Kain | 297/250 |
| 4,770,468 | 9/1988 | Shubin | 297/487 |
| 4,798,412 | 1/1989 | Kohus et al. | 297/250 |
| 4,807,928 | 2/1989 | Cone | 297/151 X |
| 4,836,605 | 6/1989 | Greenwood et al. | 297/250 |
| 4,854,638 | 8/1989 | Marcus et al. | 297/250 |
| 4,867,504 | 9/1989 | Johnson, Jr. | 297/3 |
| 4,871,210 | 10/1989 | Alexander et al. | 297/435 |
| 4,919,485 | 4/1990 | Guichon | 297/443 |

PORTABLE HIGH CHAIR/BOOSTER SEAT

This application is a continuation of application Ser. No. 07/564,249 filed Aug. 8, 1990 and abandoned on July 6, 1992.

This invention relates to an improved combination portable high chair and booster seat which comprises interlocking modular components which may be assembled and disassembled easily without the use of screws or the like. It can be used alone as a seat—with or without a tray, or it can be secured to an adult chair—with or without a tray.

Children's furniture and related devices are well known and in great use today. The standard high chair is in use today with the removable tray and various other components. Safety regulations have advanced the use of booster seats in automobiles and such booster seats are often used for children when placed on an adult chair.

It has been necessary to buy individual pieces of furniture for each use. In other words, if the two above components are needed, a separate high chair and a separate booster seat must be purchased. This is not only expensive but also creates storage problems when the items are not in use.

The present invention provides a combined portable high chair and booster seat which comprises five basic molded components, including a tray, and which may be used either as a booster seat—with or without the tray—and as a high chair when mounted on an adult chair—again, with or without the tray. The units are modular in that they are capable of being easily joined to the other units to form the booster seat and/or high chair.

Other objects of the invention will become apparent from the following description, taken together with the drawings.

SUMMARY OF THE INVENTION

The present invention provides a high chair and/or a booster seat which comprises five modular units, namely two side panels, a back panel, a seat panel, and a tray. Preferably, these units are molded from a plastic material. The back panel is designed so that it has mating protrusions which interlock with undercut openings in the side panels so as to mount the back panel between the two side panels. The seat panel is mated with a section of each of the side panels so that the side panels support the seat panel. Further, the rear end of the seat panel includes means for removably securing the seat panel to the back panel. The tray is removably secured to the upper edges of the side panels and is adjustable in a horizontal direction.

DETAILED DESCRIPTION OF THE PREFERRED EMBODIMENTS

Figure 1:
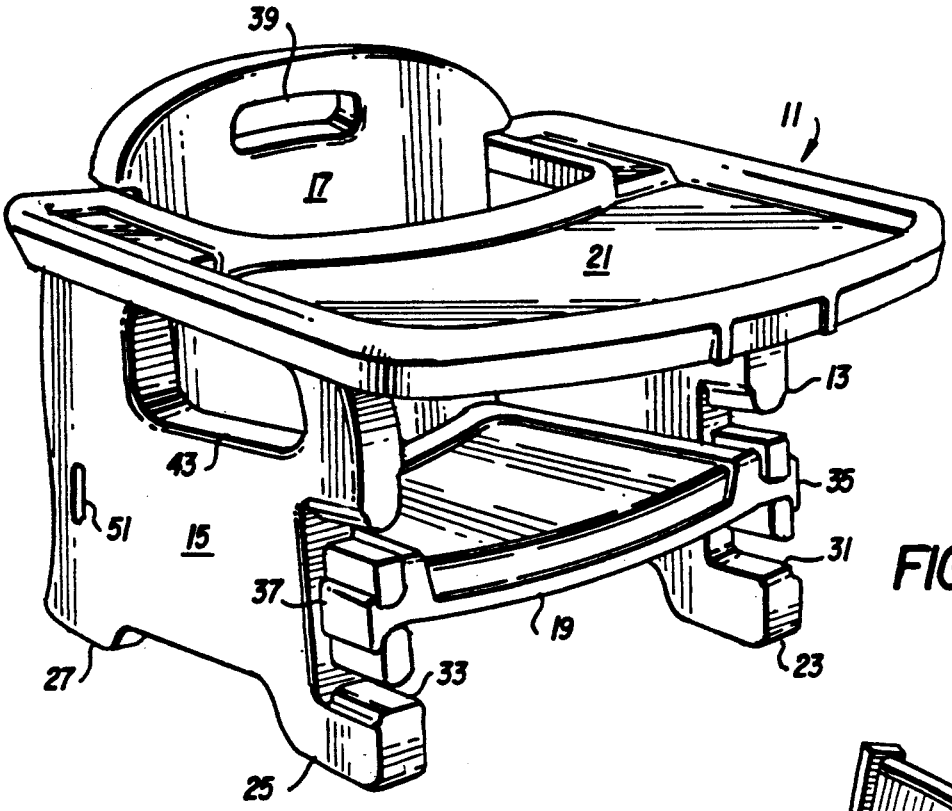
FIG. 1 is a perspective view of the assembled high chair with the tray in place.

Referring to FIG. 1, there is shown the assembled booster seat/high chair 11 of the present invention. The booster seat/high chair consists of modular side panels 13 and 15, back panel 17, seat 19, and tray 21.

Side panels 13 and 15, which form the arms of the chair, terminate at their lower ends in legs 23, 25, 27, and 29. At the front of each side panel there are three slots 31 arranged vertically above leg 23 and three slots 33 arranged vertically above leg 25. Seat 19 terminates at either side in flanges 35 and 37 with reduced sections which are slidably insertable into one of the slots 31, 33. In the showing of FIG. 1, the seat is resting in the center slots. The purpose of the multiple slots is to allow adjacent of the seat height above the legs of the side panels. It will be obvious that seat 19 is slidably removable from the position as shown in FIG. 1.

The side panels, which are mirror images of each other, also include openings 41 and 43, which permit passage of the hand for lifting and moving the seat or for carrying the individual panels when disassembled. Side panel 13 also includes belt slot 49 while side panel 15 includes belt slot 51. Seat retaining belt 50 passes through these slots.

Back panel 17 includes aperture 39, which provides for a hand hole for carrying the seat or the back panel when it is removed from the seat. Back panel 17 also includes aperture 44, through which crotch strap 48 passes. This strap is anchored within the hollow back by stay 46 (FIG. 4), which is initially inserted through back slot 44. Waist belt 54 is sewn at the back to the crotch strap, passes through a loop in the end of the crotch strap, and terminates at its distal ends in latch mechanism 56.

Figure 2:
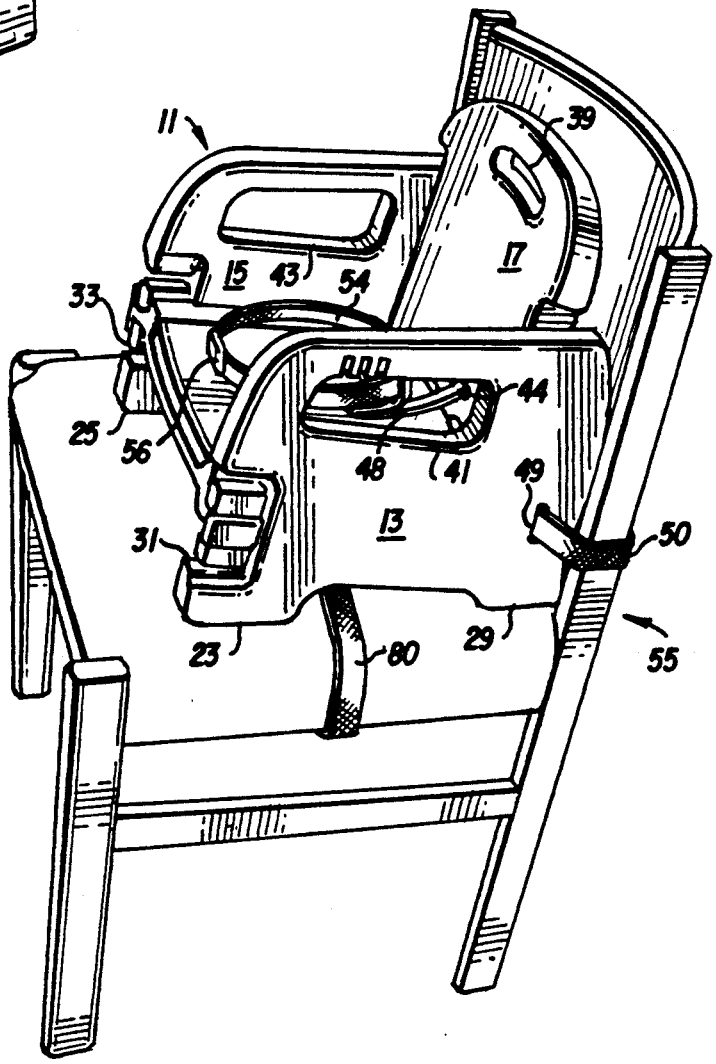
FIG. 2 is a perspective view of the booster seat, without the tray, mounted on an adult chair.
Figure 3:
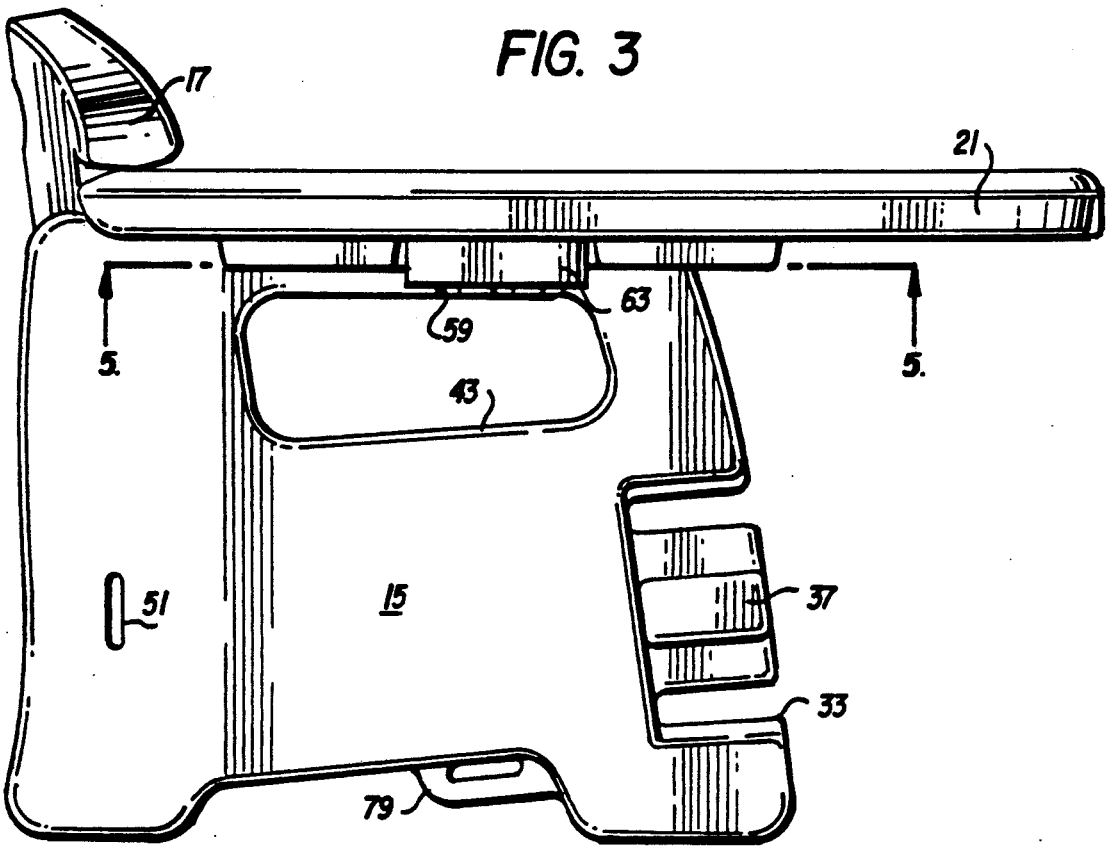
FIG. 3 is a side elevation view of the chair of FIG. 1.

Referring now to FIG. 2, seat 11, without the tray, is shown as supported by adult chair 55. As previously stated, apertures 49 and 51 are provided in side panels 13 and 15 so as to accept belt 50, which permits securing the seat to the back of adult chair 55 by means of a standard buckle (not shown). Referring to FIG. 3, the underside of side panels 13 and 15 are provided with molded loops 79 and 81 through which belt 80 passes and is secured beneath the seat of adult chair 55 by means of a standard buckle (not shown).

Figure 4:
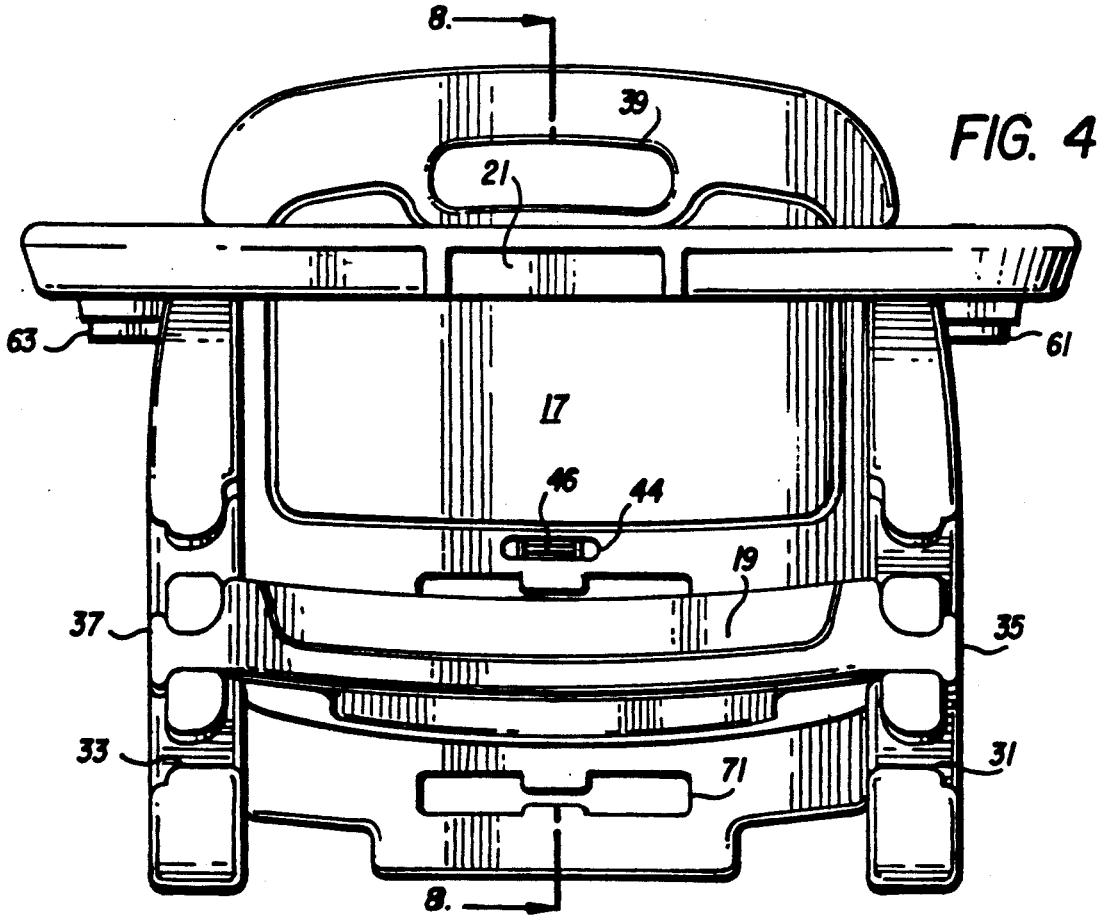
FIG. 4 is a front elevation view of the chair of FIG. 1.

Referring to FIGS. 3 and 4, slots 33 in the forward part of side panel 15 are more clearly shown with flange 37 of the seat in place in the central slot. FIG. 4 is a front elevational view and further shows three slots 71 which pass through back panel 17. As will be discussed, seat panel 19 has means at its other end which secure the seat to back panel 17. Also as shown in FIGS. 3 and 4, tray 21 has secured to the underside thereof lock plungers 61 and 63 which serve the purpose of removably attaching the tray in place on top of side panels 13 and 15.

Figure 5:
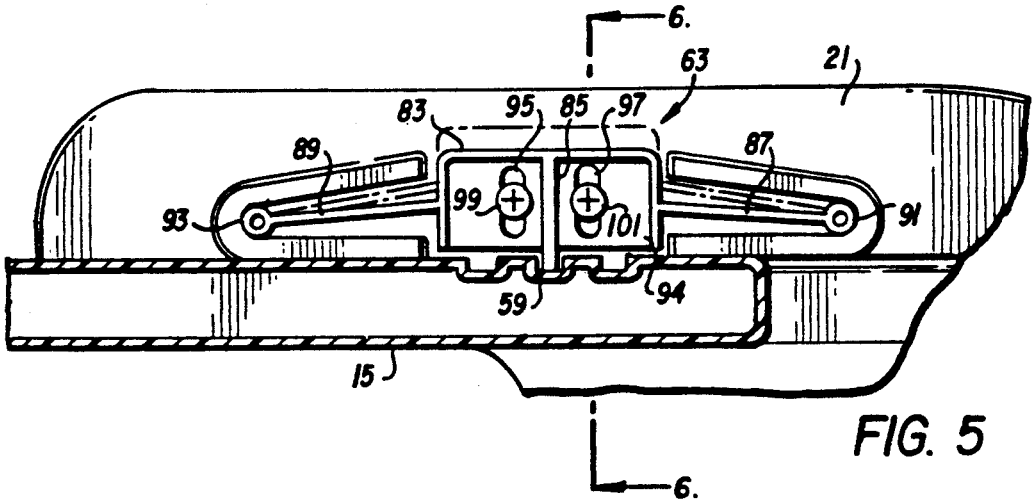
FIG. 5 is a sectional view taken through lines 5—5 of FIG. 3.
Figure 6:
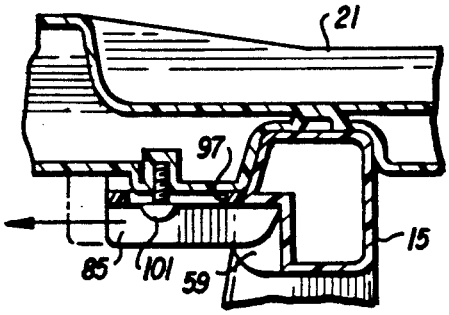
FIG. 6 a partial sectional view taken through lines 6—6 of FIG. 5.
Figure 9:
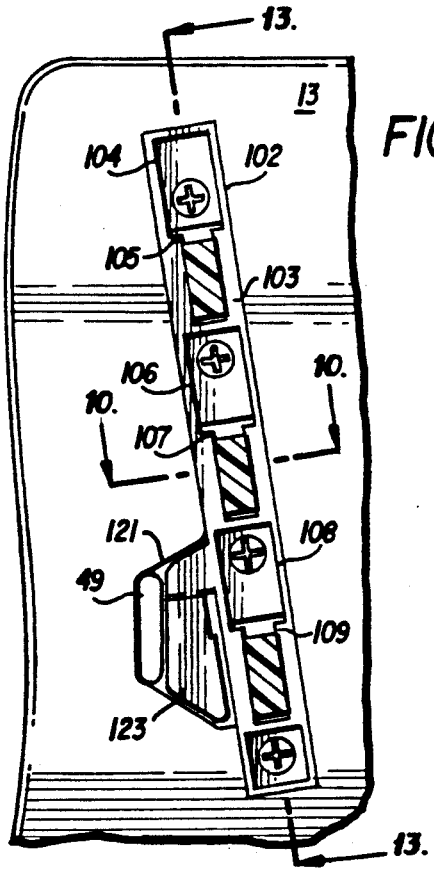
FIG. 9 is a partial view of the inner surface of one of the side panels.
Figure 13:
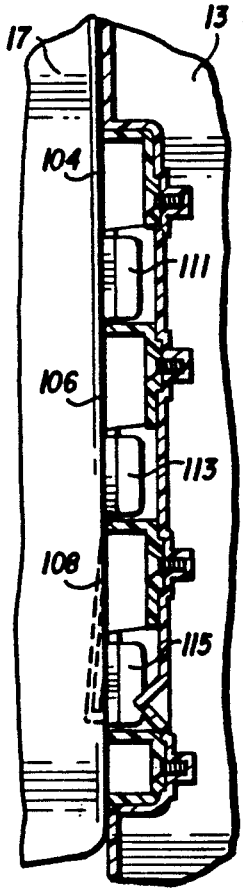
FIG. 13 is a partial sectional view showing the back panel interlocked in place on one of the side panels.

FIG. 5 is a sectional view taken along the lines 5—5 of FIG. 3, which sectional line passes through lock plunger 63. Side panel 15 includes a plurality of indentations 59. When tray 21 is placed on the top of the side panels and adjusted horizontally to the position shown in FIG. 5, housing 83 of lock plunger 63, which is mounted to the underside of the tray, is in the position shown. Housing 83 is open at its underside and has centrally located therein wall 85 which extends outwardly of the housing. Arms 87 and 89, which are flexible, extend from housing 83 to the underside of tray 61. The distal ends of the arms float in pockets 91 and 93, which are molded into the tray. Since these arms are flexible, they act as a spring. Housing 83 has two slots 95 and 97 which are elongated and in which are located two guide screws 99 and 101. These screws are not tightened but allow housing 83 to be moved under pressure of fingers or the like in the direction as shown by the dotted lines. Arms 87 and 89 normally bias housing 83 inwardly so as to place wall 85 in the adjacent slot on the side panel—in this case, slot 59. As will be apparent, this prevents horizontal motion of the tray and secures it in place. Preferably, housing 83 and arms 87 and 89 are molded of plastic as a single unit. Details of the mechanism are further shown in FIG. 6, which indicates the direction of movement of housing 83 if the tray is to be released.

Figure 7:
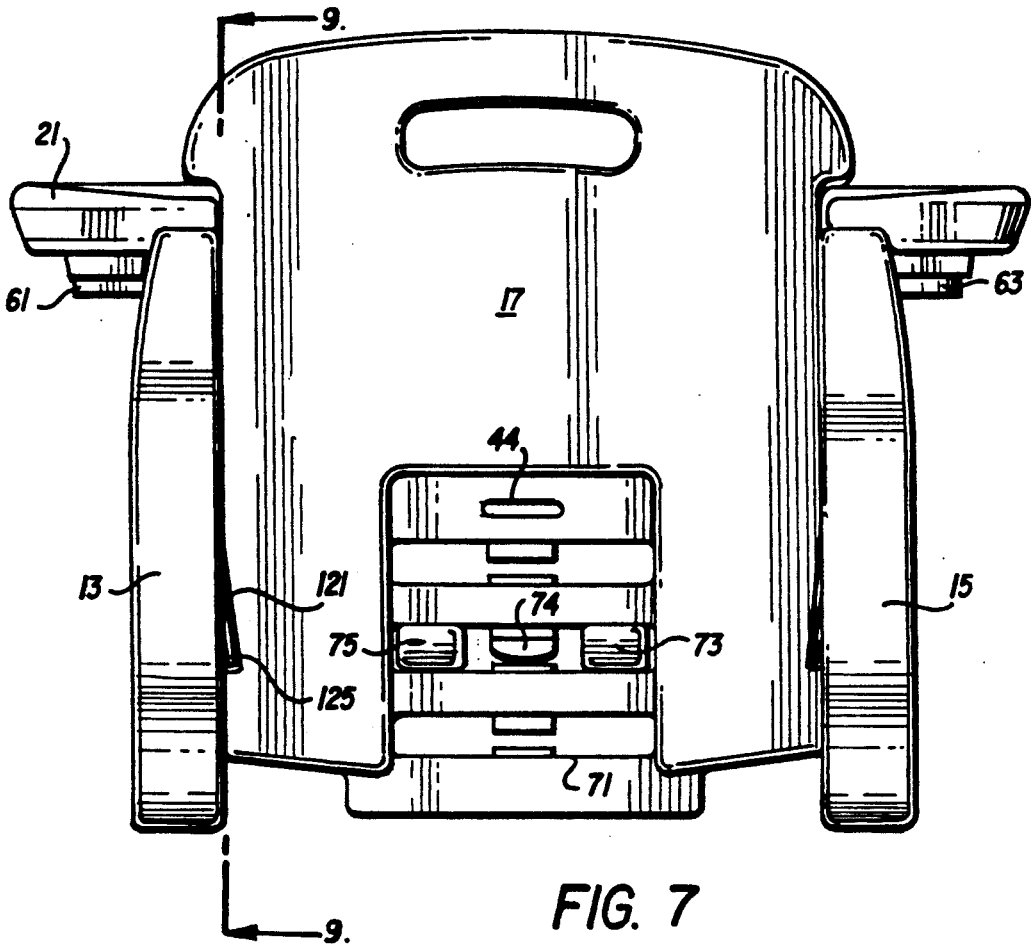
FIG. 7 is a rear view of the seat of FIG. 1.

Referring now to FIG. 7, there is shown a rear view of the booster seat/high chair 11 of FIG. 1. As can be seen, back panel 17 includes three horizontal slots 71 which are spaced vertically as shown. The spacing of these slots matches the spacing of slots 31, 33 in the forward edges of side panels 13 and 15. Molded integrally with the back edge of seat panel 19 are projections 73, 74, and 75. Projections 73 and 75 are rigid and fit within the outer sections of slot 71 near the rear of back 17 so as to provide vertical support for seat 19. Central projection 74 is flexible and terminates at its outer end in a shoulder which is cammed outwardly so that insertion of the seat to its fixed position causes projection 74 to flex downwardly and then snap upwardly so that the shoulder abuts the back of the seat and thereby locks the seat panel in the position desired. When it is desired to dismantle the chair, projection 74 is manually biased downwardly so that seat panel 19 may then be horizontally removed.

Figure 8:
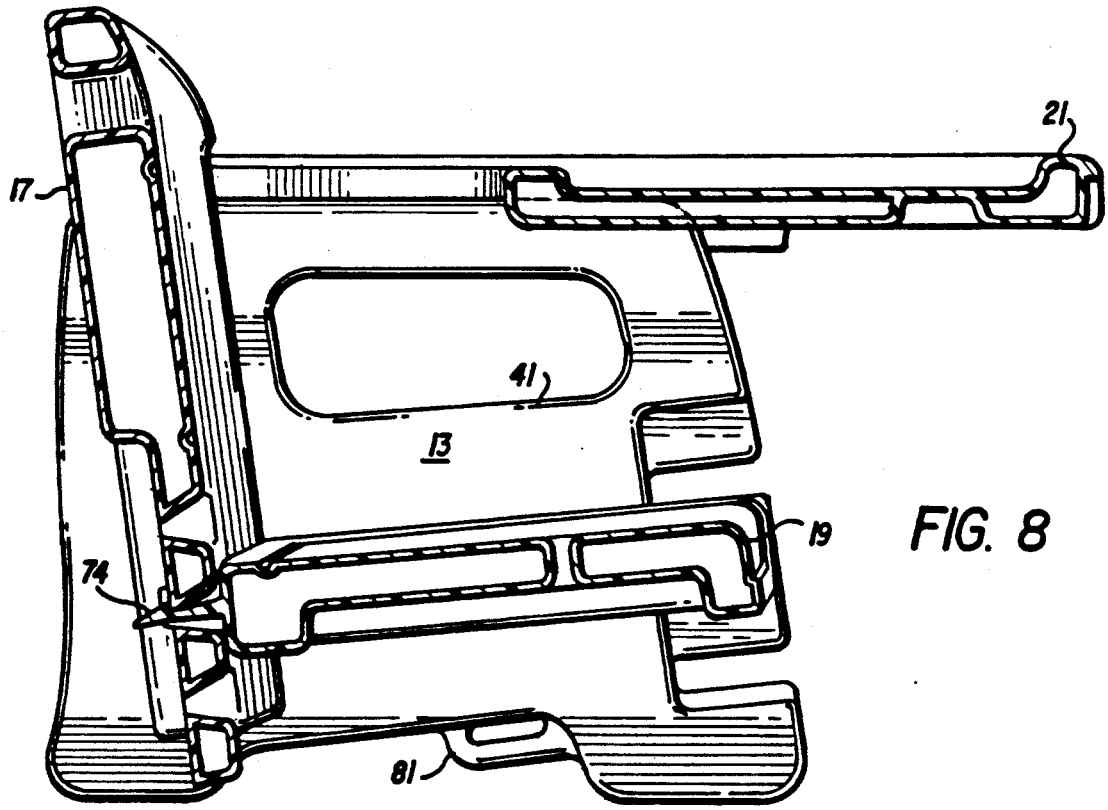
FIG. 8 is a sectional view taken through lines 8—8 of FIG. 4.

Details of flexible projection 74 are more clearly shown in FIG. 8, wherein seat 19 is in place and interlocked with back panel 17.

FIGS. 9—13 illustrate the manner in which back panel 17 interlocks with side panels 13 and 15. Only one of the side panels will be discussed inasmuch as the panels are mirror images. Further, one side of the back panel is shown inasmuch as both sides of the back panel are identical. While it is understood that the structure illustrated in FIG. 9 could be molded or could be machined after molding, it is much simpler and more economical to construct this particular part of the seat in the manner to be described.

Figure 10:
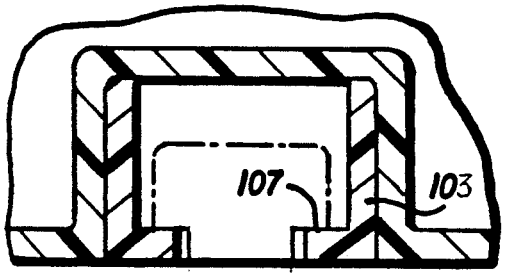
FIG. 10 is a sectional view taken through lines 10—10 of FIG. 9.

Side panel 13 is molded so as to include groove 102 extending at a slight angle from the vertical. Retainer 103 is secured within groove 103 by means such as flat-headed screws or the like and includes therein recesses 104, 106, and 108 which terminate in undercut sections 105, 107, and 109, as illustrated in FIG. 10. Additionally, recess 121 is molded into the back panel so as to accommodate flexible finger 125, which, in its unbiased position, extends outwardly from the plane of the back panel. When the side panel is fitted to the back panel, flexible finger 125 snaps into recess 121 (FIG. 7) so as to lock the panels together. The same finger recess relation exists on the other side of the back and the other side panel. The flexible fingers must be depressed for removal of the side panels.

Figure 12:
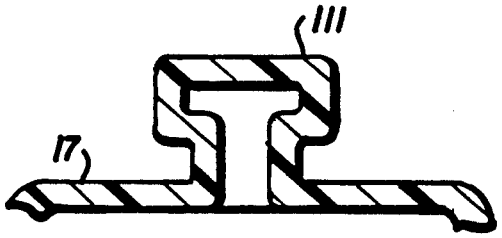
FIG. 12 is a sectional view taken through lines 12—12 of FIG. 11.
Figure 11:
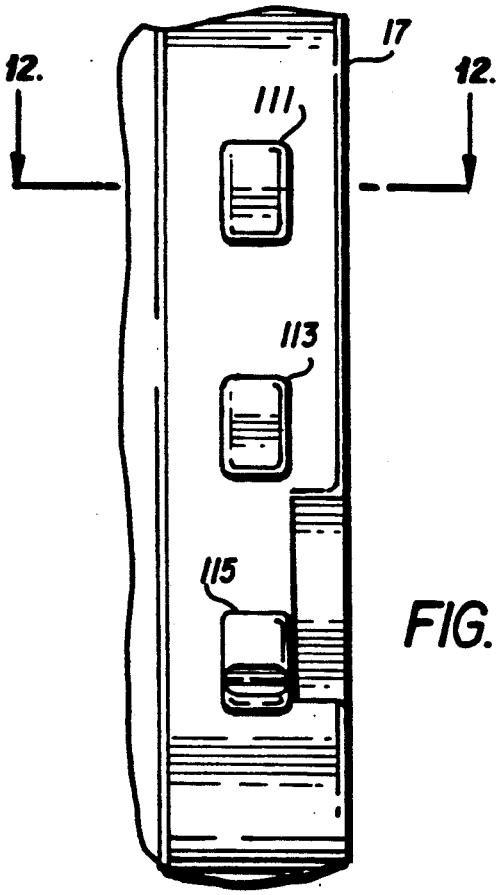
FIG. 11 is a partial view of one side of the back panel.

Referring to FIG. 11, the outer edges of back panel 17 include dovetail protrusions 111, 113 and 115 which are of an outer dimension to fit within spaces 104 of retainer 103, as illustrated in FIG. 12. This allows protrusions 111, 113, and 115 to be placed into sections 104, 106, and 108 and then dropped so that they fit within undercut sections 105, 107, and 109. This, together with flexible finger 123, interlocks back panel 17 to side panels 13 and 15.

It is to be understood that the above description and drawings are illustrative only since equivalent structural elements could be used without departing from the invention, the scope of which is to be limited only by the following claims.

We claim:

1. Apparatus for removably attaching a tray to a chair, said apparatus comprising a chair having a seat, back, and arms;

a plurality of slots in the outer upper portions of said arms;

a tray having a length greater than the distance between said arms of said chair;

first and second latches connected to the underside of said tray at opposite ends thereof, the distance between said latches being substantially the same as the distance between the outer upper portions of said arms of said chair, each of said latches comprising a housing;

a substantially rigid wall secured substantially centrally within said housing and extending outwardly of said housing toward the center of said tray, said wall being of a dimension to fit within a selected one of said slots;

means for securing said housing to said tray so that said housing is slidable towards and away from the center of said tray;

a flexible arm connected to either side of said housing and extending outwardly therefrom, said flexible arms being restrained at their distal ends by said tray so as to bias said housing in the direction of the center of said tray;

whereby manual movement of each of said housings against the bias of said flexible arms allows the tray to be placed on the arms of said chair and aligned with a selected one of said slots and release of said housing to said biased position causes said wall to enter said selected slot.

2. The apparatus of claim 1 wherein said housing and said flexible arms are molded as a single unit.

3. The child's seat comprising two substantially identical, but mirror-imaged, modular side panels;

a modular back panel having a front surface and a back surface;

an undercut area in each of said side panels;

a mating dovetail projection on either side of said back panel, each of said dovetail projections mating with an adjacent one of said undercut areas in said side panels;

flanges extending outwardly on either side of said seat panel;

a slot through said back panel;

slots in said side panels opposite said back for accepting said flanges so as to support said seat in a substantially horizontal position; and a flexible finger on said seat panel having a shoulder for passing through said slot of said back panel, said shoulder abutting the back surface of said back panel adjacent said slot.

4. The child's seat of claim 3 further comprising a tray;

means for removably mounting said tray on said side panels.

5. The child's seat of claim 3 further comprising a waist strap secured to said back panel;

a crotch strap secured to said waist strap; and means for securing said waist strap and said crotch strap about the occupant of said seat.

6. The child's seat of claim 3 further comprising a crotch strap anchored within said back panel and passing outwardly therefrom, said crotch strap terminating in a loop at its distal end;

a waist belt secured substantially at its center to the inner portion of said crotch strap and passing through said loop of said crotch strap; and mating buckle parts at the terminal ends of said waist belt.

* * * * *

UNITED STATES PATENT AND TRADEMARK OFFICE

CERTIFICATE OF CORRECTION

PATENT NO. : 5,183,311

DATED : FEBRUARY 2, 1993

INVENTOR(S) : MEEKER ET AL

It is certified that error appears in the above-identified patent and that said Letters Patent is hereby corrected as shown below:

Column 2, lines 27 and 28, delete "adjacent" and substitute
therefor --adjustment--.

Column 4, line 57, claim 3, delete "The" and substitute
therefor --A--.

Signed and Sealed this

Thirty-first Day of January, 1995

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,183,311

DATED : February 2, 1993

INVENTOR(S) : Meeker et al

It is certified that error appears in the above-identified patent and that said Letters Patent is hereby corrected as shown below:

Column 4, Line 61, Claim 3; after "back surface;" insert --a modular seat panel;--.

Signed and Sealed this

Thirteenth Day of June, 1995

*Attest:*

*Attesting Officer*

Bruce Lehman

BRUCE LEHMAN

*Commissioner of Patents and Trademarks*